US012325502B2

(12) United States Patent
Toy

(10) Patent No.: US 12,325,502 B2
(45) Date of Patent: Jun. 10, 2025

(54) ROBOTIC-THROTTLE CONTROL OF A FISHING VESSEL

(71) Applicant: Joel R. Toy, Corona, CA (US)

(72) Inventor: Joel R. Toy, Corona, CA (US)

( * ) Notice: Subject to any disclaimer, the term of this patent is extended or adjusted under 35 U.S.C. 154(b) by 0 days.

(21) Appl. No.: 18/943,586

(22) Filed: Nov. 11, 2024

(65) Prior Publication Data

US 2025/0153837 A1 May 15, 2025

Related U.S. Application Data

(60) Provisional application No. 63/599,192, filed on Nov. 15, 2023.

(51) Int. Cl.

| | |
|---|---|
| ***B63H 21/21*** | (2006.01) |
| ***B63B 35/14*** | (2006.01) |
| ***B63B 49/00*** | (2006.01) |
| ***B63H 20/00*** | (2006.01) |

(52) U.S. Cl.

CPC ..... *B63H 21/213* (2013.01); *B63B 35/14* (2013.01); *B63B 49/00* (2013.01); *B63H 20/007* (2013.01); *B63H 2021/216* (2013.01)

(58) Field of Classification Search

None

See application file for complete search history.

(56) References Cited

U.S. PATENT DOCUMENTS

| | | | | |
|---|---|---|---|---|
| 9,446,832 | B2 * | 9/2016 | Guglielmo | B63H 21/213 |
| 2023/0294809 | A1 * | 9/2023 | Buchanan | B63H 20/12 701/22 |

OTHER PUBLICATIONS

"ITroll Generation 2 Owner's Manual Software Version: OS6.0", Nov. 2014, https://www.itroll.us/iTroll.downloads/OS6.iTroll.owners.pdf.

* cited by examiner

*Primary Examiner* — Todd Melton

(74) *Attorney, Agent, or Firm* — Burns Patent Law

(57) ABSTRACT

A robotic throttle-control system for controlling a throttle-power setting of a throttle of a fishing vessel is provided. The control unit has a processor unit that instructs the control unit of the throttle-power setting at which to set the throttle and a time span for maintaining the throttle at the throttle-power setting. A user interface of the control unit has a dual-mode switch that communicates to the processor unit through both a rotational position of the dual-mode switch and an axial position of the dual-mode switch.

20 Claims, 9 Drawing Sheets

900

| | Throttle<br>Cut - Troll<br>Troll - Bump |
|---|---|
| Compression | |
| Gain = -7 | 0 - 5% |
| Gain = -6 | 0 - 6 % |
| Gain = -5 | 0 - 7% |
| Gain = -4 | 0 - 8% |
| Gain = -3 | 0 - 9% |
| Gain = -2 | 1 - 10% |
| Gain = -1 | 2 - 11% |
| Programmed settings | |
| Gain = 0 | 3 - 12% |
| Gain = 1 | 4 - 13% |
| Gain = 2 | 5 - 14% |
| Gain = 3 | 6 - 15% |
| Gain = 4 | 7 - 16% |
| Gain = 5 | 8 - 17% |
| Gain = 6 | 9 - 18% |
| Gain = 7 | 10 - 19% |

FIG. 5

ROBOTIC-THROTTLE CONTROL OF A FISHING VESSEL

CROSS-REFERENCES TO RELATED APPLICATIONS

This application claims priority to U.S. Provisional Application No. 63/599,192, filed Nov. 15, 2023, and entitled "ROBOTIC-THROTTLE CONTROL OF A FISHING VESSEL," the disclosure of which is hereby incorporated by reference in its entirety.

BACKGROUND

As any proud troller holding a huge fish is likely to tell you, proper speed control of your fishing vessel is critical to successful fishing. A well-controlled fishing vessel can animate the trolled bait and entice a predatory fish to strike. By varying the position of the fishing vessel's engine throttle, the speed of the vessel can be increased or decreased accordingly. While some people are gifted with a natural understanding of how precise throttle control can produce successful fishing, it is difficult for most fishers to make the requisite precise throttle variations that properly animate the trolled bait. What is needed is a way to share with more fishers the benefits of properly controlling the speed of a trolling vessel. The present disclosure is directed to a robotic-throttle control system that addresses one or more deficiencies with current methods and systems for controlling the speed of a fishing vessel.

SUMMARY

Certain embodiments of the disclosure comprise a robotic-throttle control system configured for precise control of a throttle for a fishing vessel. The robotic-throttle control system disclosed herein can allow a user to input, or to select, a program of two or more pairings of a throttle-power setting and a power-duration setting. The throttle-power setting can specify the power setting for the robotic-throttle control system to set the throttle. The power-duration setting can specify the amount of time the robotic-throttle control system should maintain the throttle at the throttle-power setting that is paired with the power-duration setting. In some aspects, the robotic-throttle control system can include a gain setting that allows a user to adjust in real time (e.g., while the program of throttle settings is running) the throttle-power setting without changing the value for the throttle-power setting stored in a memory of the robotic-throttle control system. In some aspects, the gain setting can be adjusted through a user interface that includes a dual-stage switch such as a ring dial that surrounds a core button. In some arrangements, the ring dial can be configured with a safety clutch mechanism such that a rotational movement of the dial is disregarded by the control system if the rotational speed of the dial is above a certain threshold value (e.g., 10 rpm).

BRIEF DESCRIPTION OF THE DRAWINGS

Embodiments of the present disclosure will now be described hereinafter, by way of example only, with reference to the accompanying drawings in which:

FIG. 5 depicts an illustrative, non-limiting example of a hunt gain compression, according to some aspects of the present disclosure.

DETAILED DESCRIPTION

Overview

This disclosure relates generally to a robotic throttle-control system for controlling precisely the speed of a fishing vessel. In some aspects, the throttle-control system can be used on a trolling vessel to impart a desired movement to the trolled bait. In some aspects, the novel throttle-control system disclosed herein can execute a pre-programmed throttle-position template to achieve a desired speed control of the fishing vessel. In some arrangements, the system can allow the user to vary one or more inputs of a pre-programmed throttle-position template. In certain variations, the system can allow the user to customize a pre-programmed throttle-position template to achieve a desired variation of the pre-programmed throttle-position program. In some arrangements, if a pre-programmed template is changed by the user, the new values overwrite the values in the systems processor memory, allowing this "new" template to be recalled by the user. In some arrangements, the robotic throttle-control system can be configured to operate in a gain mode that allows the user to temporary adjust the throttle-power setting (also referred to herein as throttle position) in real-time without permanently changing the throttle-power setting in the memory of the processor unit of the robotic throttle control system, which can be useful to account for changes in weather conditions. In some aspects, the robotic throttle-control system can include a tactile click dial configured to allow a user to maintain free vision of the waterway while adjusting the click dial by feel alone. In some arrangements, the tactile click dial can be configured to also provide audible feedback to further enhance the user experience of the robotic-throttle control system. In some arrangements, the click dial can be a component of a dual-mode switch that detects the rotational position of the click dial and detects whether the click dial is compressed along the axis of the dial. In some arrangements, the effect of the click dial on the rate of throttle change can be limited by software that is encoded in the processor unit of the system and that acts as an electronic safety clutch in case of rapid or unintended movement of the click dial. In some arrangements, the safety clutch can include the processor unit of the robotic-throttle control system disregarding an input from the dual-mode switch or dial when the rotational speed of the dial exceeds a certain threshold (e.g., 10 rpm) that would be indicative of an unintentional movement of the dial.

Robotic Throttle-Control System

Figure 1:
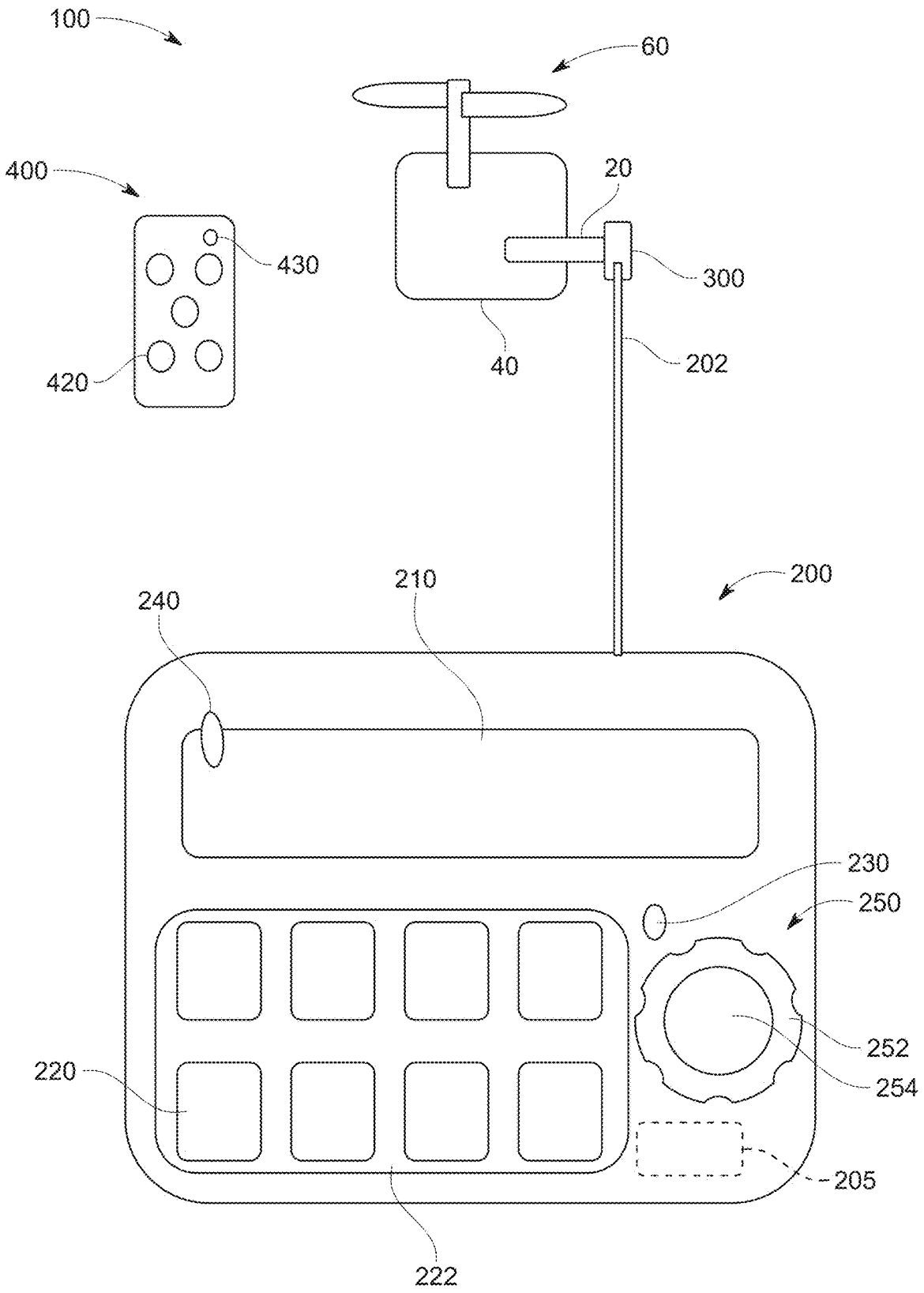
FIG. 1 depicts a schematic representation of a robotic-throttle-control system, according to some aspects of the present disclosure.

FIG. 1 depicts schematically an illustrative, non-limiting example of a robotic throttle-control system 100, according to some aspects of the present disclosure. As described more fully herein, the system 100 can include a control unit 200 adapted to control a throttle 20 of a motor 40 that powers a propulsion unit 60 (e.g., propeller, jet drive, etc.) of a fishing vessel (not shown). FIG. 1 illustrates the robotic-throttle control system 100 configured to control a motor that has a mechanical throttle by the control unit 200 communicating with, and controlling the position of, a servo motor 300 that is attached to the throttle 20. In some arrangements, however, the system 100 can be configured to control a motor with a digital throttle (e.g., a "fly by wire" throttle). For example, the control unit 200 can be configured to send a digital signal to a digital throttle to inform the digital throttle of how much throttle is being requested. The servo motor 300 (or digital controller) can be adapted to impart precise positional changes to the throttle 20 according to input the servo motor 300 (or digital throttle) receives from the control unit 200. For the sake of simplicity, the system 100 will be described herein with respect to a servo motor 300 controlling a mechanical throttle. However, the skilled artisan will appreciate the robotic-throttle control system 100 can be configured to control a digital throttle with a digital controller. In the illustrated embodiment, the control unit 200 communicates with the servo motor 300 through one or more electrical wires 202. In some arrangements, the control unit 200 can communicate wirelessly with the servo motor 300. The system 100 can include a remote 400. The remote 400 can be adapted to communicate commands remotely to the control unit 200 through one or more remote input buttons 420. In some aspects, the remote 400 can be adapted to control remotely the throttle 20 through the servo motor 300 by way of the control unit 200.

FIG. 1 illustrates, for ease of clarity, a system 100 that controls a single servo motor 300 and a single motor 40. In certain arrangements, the system 100 can control two or more independent motors through two or more independently operated servo motors 300. For example, the system 100, in a two-motor application, can be configured to run two servo motors 300 at the same time with one servo motor 300 controlling the throttle 20 of a right-side motor at the stern of the vessel and with the other servo motor 300 controlling a left-side motor at the stern of the vessel. In some arrangements, the robotic-throttle control system 100 can include multiple control units 200 configured to communicate with one another. For example, the system 100 can be configured as one or more control heads that are networked to communicate with a master module to control the system 100. This can allow the user to control the system 100 from multiple locations in the fishing vessel. Large fishing vessels, for example, can have two or even three "helm stations" with networked control heads, allowing motor control at each station. The control head (or the control unit 200) can have a graphical touch screen with programmable graphics, zoom, and shrink to adjust graphics size and touch areas. A change by a user of throttle settings or operational mode on any control head can be automatically updated across the other control heads, keeping synchronization across all points of potential user input to the system 100.

With continued reference to FIG. 1, the control unit 200 can include a processor unit 205, a display 210, one or more input buttons 220, an indicator 230 (e.g., an orange-colored LED), a light sensor 240, and a dual-mode switch 250. The control unit 200 can include one or more processors, memory storage devices, and other electrical circuitry that, for the sake of clarity, are referred to herein as a processor unit 205. The processor unit 205 can be configured to receive input from a user interface, display output to a display screen, access programs stored in memory, communicate wirelessly with other devices, and output control commands to the throttle (e.g., through the servo motor 300 or digital controller). The one or more input buttons 220 can be arranged on a keypad 222, as shown in FIG. 1. In some arrangements, the keypad 222 can be backlit with one or more LEDs to facilitate use of the keypad 222, as described herein. The dual-mode switch 250 can include an outer ring portion 252 that circumferentially surrounds an inner core portion 254. In some aspects, the outer ring 252 can provide tactile feedback in the user's hand and audible output to the user's ear. The dual-mode switch 250 can have eight, sixteen, or thirty-two or other number of detents per 360-degree rotation of the outer ring 252 about the core portion 254. The dual-mode switch 250 can be a digital device (e.g., click dial, encoder) that puts out a digital signal that varies in a set pattern when the dual-mode switch 250 is rotated. This can enable the software of the processor unit 205 to detect how far, and in which direction, the outer ring 252 has been turned. In some arrangements, the core portion 254 can have a shaft switch that is activated by pressing down on the core portion 254. The remote 400 can similarly include one or more remote input buttons 420, an indicator 430. In some arrangements, a shaft of the dual-mode switch 250 can have under the shaft a switch that is read by the system 100 to determine a user input indicated by user interaction with the dual-mode switch 250.

Figure 2A:
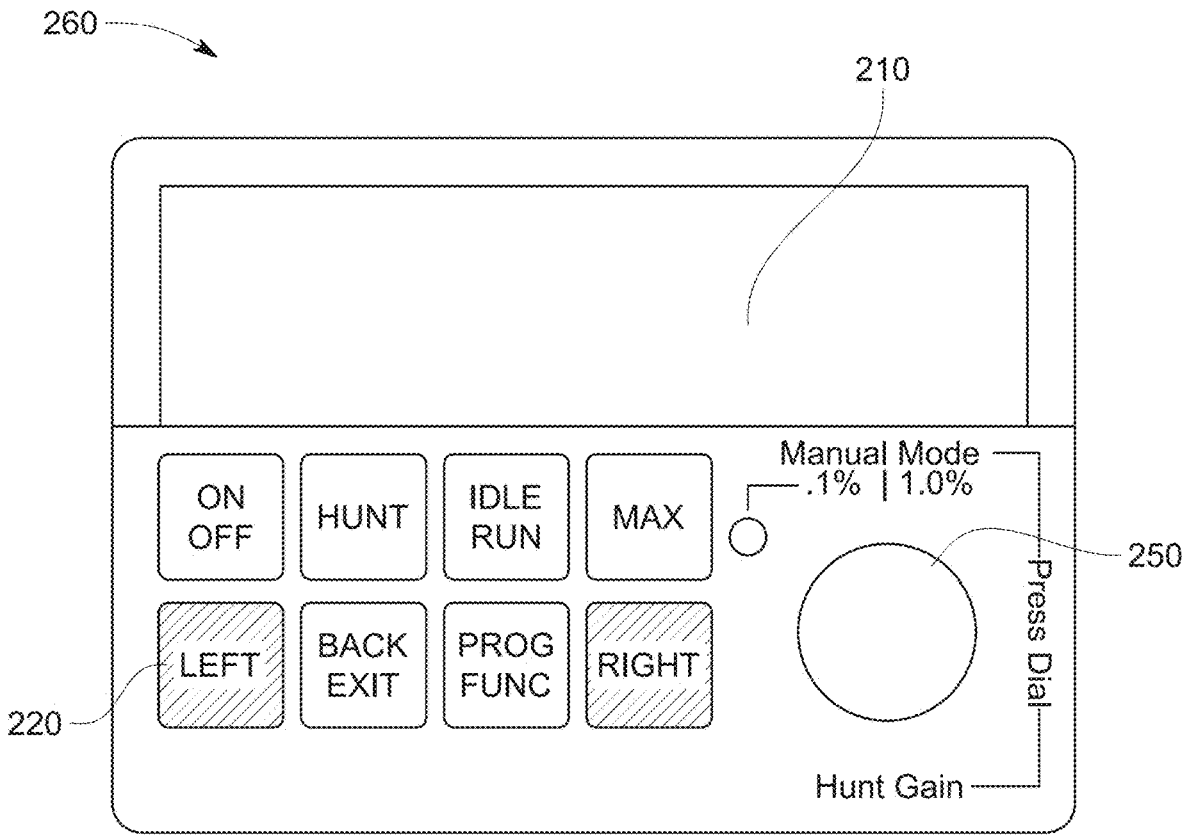
FIG. 2A depicts an illustrative, non-limiting example of a control interface for a robotic-throttle-control system, according to some aspects of the present disclosure.
Figure 2B:
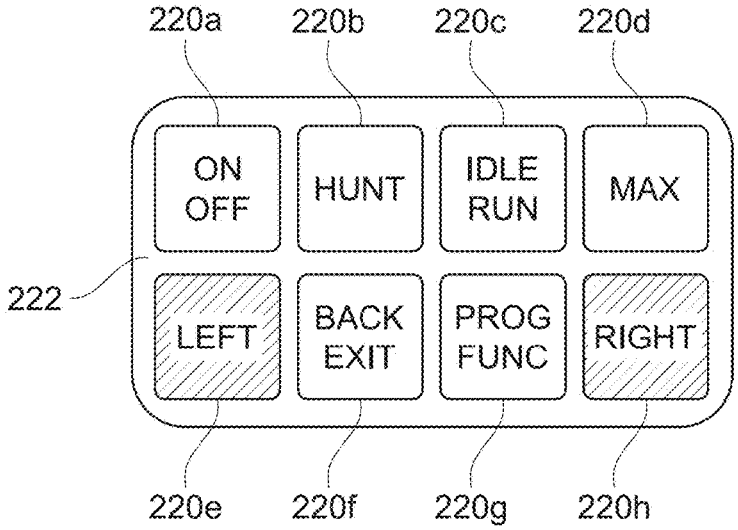
FIG. 2B depicts an illustrative, non-limiting example of a keypad arrangement for the control interface of FIG. 2A.

FIG. 2A shows a non-limiting, illustrative arrangement of a control interface 260 of the control unit 200. The control interface 260 can include the display 210, the input buttons 220, and the dual-mode switch 250. The display 210 can be configured to display text characters, numeric characters, and other symbols (e.g., an arrow). FIG. 2B illustrates a non-limiting, illustrative arrangement of a keypad 222 having the following eight input buttons 220: an On/Off button 220*a*, a Hunt button 220*b*, an Idle/Run button 220*c*, a Max button 220*d*, a Left button 220*e*, a Back/Exit button 220*f*, a Prog/Func button 220*g*, a Right button 220*h*. The function of each of the input buttons 220 shown in the keypad 222 of FIG. 2B is described more fully herein and explained in the context of operational control of the system 100.

In some aspects, the control unit 200 can include one or more safety features and convenience features. For example, in some arrangements the control unit 200 can include a keypad 222 that is backlit to facilitate a user comprehending the identity of an input button 220 (e.g., the On/Off button 220*a*, the Hunt button 220*b*, the Idle/Run button 220*c*, the Max button 220*d*, the Left button 220*e*, the Back/Exit button 220*f*, the Prog/Func button 220*g*, the Right button 220*h*). In some arrangements, the keypad 222 can be lit by one or more LEDs inlaid in the control unit 220 under one more input buttons 220. In certain arrangements, twelve LEDs are used to illuminate the input buttons 220 of the keypad 222 and to illuminate other lettering and logos on the keypad 222. In some aspects, the LED that backlights the keypad 222 can be inlaid under a portion of, or under an entirety of, the keypad 222. The intensity of the LED can be selected to enhance visibility of the keypad 222 during night or low light fishing. In some arrangements, the ambient lighting conditions can be monitored, for example, with a light sensor 240 to monitor how the lighting conditions are changing so that the keypad 222 is lit only when necessary to conserve battery power. In some arrangements, the dual-mode switch 250 can include a safety clutch feature configured so that turning of the outer ring 252 at a rapid rate limits the amount of throttle change that occurs. This safety-clutch feature of the dual-mode switch 250 can limit unintended throttle response to gross movement of the outer ring 252, which could occur, for example, when someone falls while holding the dual-mode switch 250, or when the outer ring 252 is spun by a hand or arm when someone reaches over the dual-mode switch 250 to grab something.

Figure 2C:
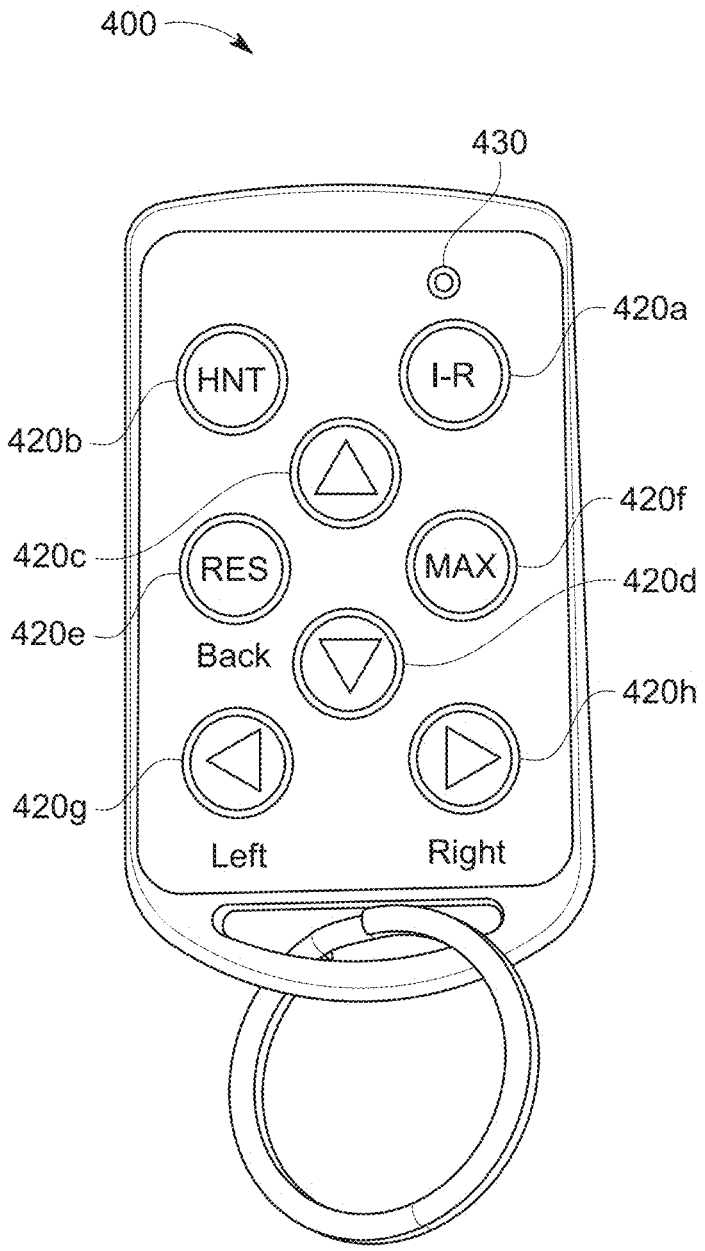
FIG. 2C depicts an illustrative, non-limiting example of a remote for a robotic-throttle control system, according to some aspects of the present disclosure.

FIG. 2C depicts a non-limiting, illustrative example of a remote 400 (FIG. 1) of a robotic-throttle control system 100. The remote 400 can include multiple remote-input buttons 420 and can include a multi-touch capability that expands the possibilities of data input through the remote-input buttons 420 by allowing the user to input commands through simultaneous activation of different combinations of input buttons 420 in addition to individually activating the remote-input buttons 420. In some aspects, the remote 400 can include eight remote input buttons 420 and further configured to process more than eight functions because the remote 400 can process when one remote input button 420 is pressed simultaneously with another remote-input button 420. As shown in FIG. 2C, the remote 400 can include an I-R remote button 420*a*, a Hunt remote button 420*b*, an Up remote button 420*c*, a Down remote button 420*d*, a Res remote button 420*e*, a Max remote button 420*f*, a Left remote button 420*g*, a Right remote button 420*h*.

In some aspects, the remote 400 can be linked or paired with the system 100. In some arrangements, confirmation that a remote 400 is paired with the system 100 can include: beginning with the system 100 powered off; pressing any remote input button 420 on the remote 400. If the remote 400 is paired with the system 100, the system 100 will wake up and confirm the paired status on the display screen 210. If the remote 400 is paired with the system 100, the display 210 can be configured to indicate whether the battery of the remote 400 is good or needs replacing. In some arrangements, the system 100 can include routines in an operations menu to pair or unpair a remote 400 with the system 100. This can allow, for example, a quick pairing that can be done "in the field." In some arrangements, the system 100 can quickly manage multiple remotes 400 to pair or unpair with the system 100. This could allow friends with a remote 400 to fish on one another's boat by easily pairing their remotes 400 to one another's system 100. The remotes 400 can similarly be easily unpaired with the system 100 after an outing has ended. In some aspects, the control unit 200 can be mounted to the fishing vessel by an integrated-ball mount. The integrated-ball mount can be compatible with a RAM mount "B" size component, for example, and a control head of the system 100 can be detached from the ball mount without removing the ball from the RAM arm. This preserves the angles at which the mount was adjusted for enhanced user friendliness of the system 100.

Figure 3:
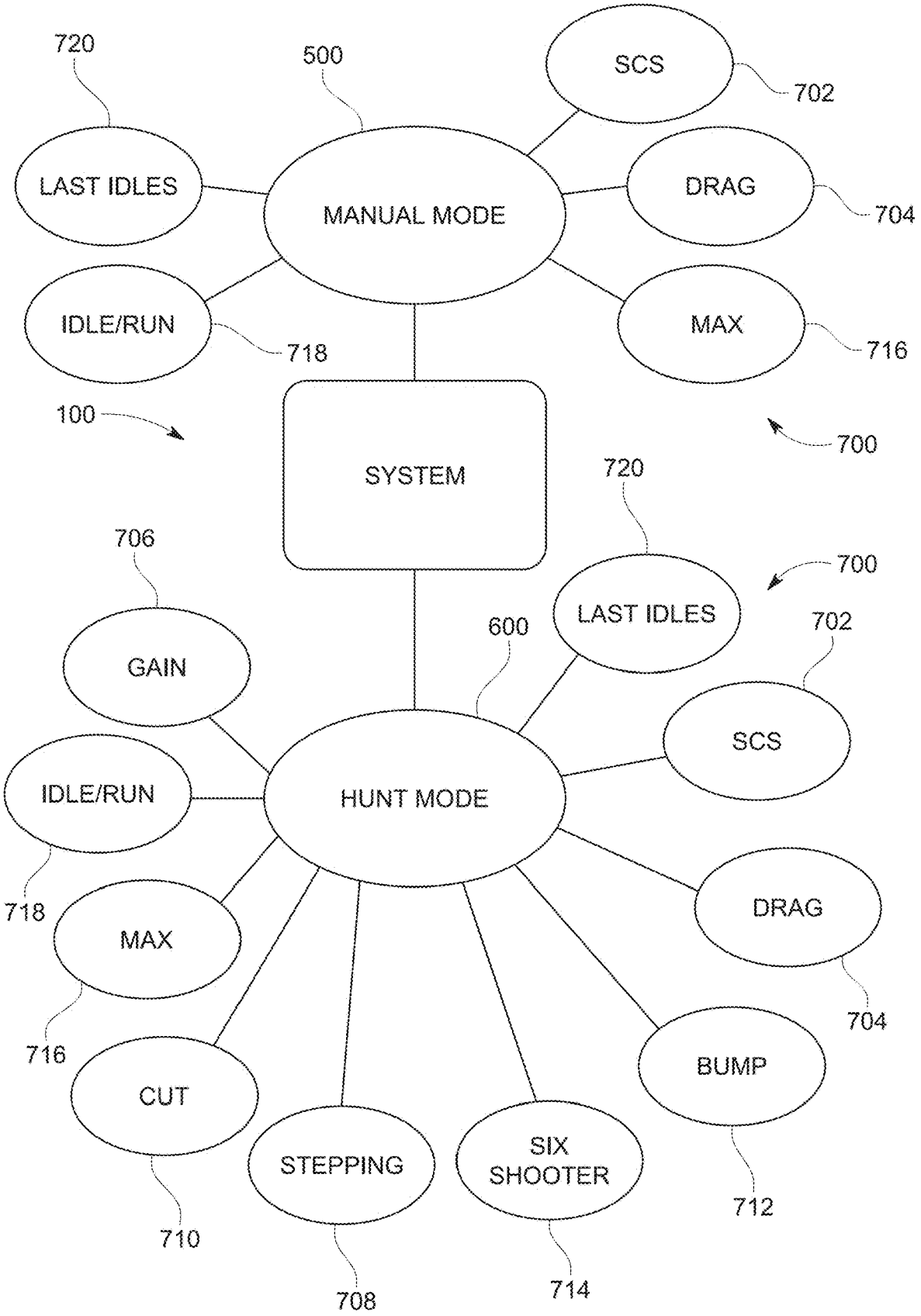
FIG. 3 depicts a schematic representation of operational modes of a robotic-throttle-control system, according to some aspects of the present disclosure.

FIG. 3 depicts schematically a non-limiting, illustrative operational arrangement of the system 100. The operational arrangement can be encoded or programmed on a processor of the processor unit 205 of the robotic-throttle control system 100. The system 100 can be configured to operate in a manual mode 500 or in a hunt mode 600. As shown in FIG. 3, the system 100 can be configured to allow one or more throttle-control functions 700 to be performed by the system 100. Each of the manual mode 500 and the hunt mode 600 can include one or more throttle-control functions 700. For example, FIG. 3 illustrates the manual mode 500 can include a secondary-cruising-speed (SCS) function 702, a drag function 704, a max throttle function 716, an idle/run function 718, and a last idles function 720, while the hunt mode 600 can include an SCS function 702, a drag function 704, as well as a gain function 706, a stepping function 708, a cut function 710, a bump function 712, a six-shooter function 714, a max throttle function 716, an idle/run function 718, and a last idles function 720. Each of these functions is described more fully below.

In some arrangements, the system 100 can be turned on at the control unit 200 by pressing the On/Off button 220*a*. The system 100 can be turned on remotely by pressing and holding the I-R remote button 420*a* and then pressing and holding the Hunt remote button 420*b*. In some arrangements, the system 100 can be turned off by holding for three seconds the On/Off button 220*a*. The system 100 can be turned off remotely by holding the I-R remote button 420*a* and then holding the Hunt remote button 420*b* for three seconds.

In some aspects, the system 100 can allow use of the throttle 20 in the manual mode 500. For example, the motor 40 can be started and allowed to warm up until the motor 40 idles smoothly, at which time the system 100 can be powered on as described herein. For tiller motors, a tension knob on the rotating throttle handle can be released to prevent sticking, and the motor 40 at idle speed can be placed to engage a forward gear. For a remote tiller, the motor 40 can be put in gear with the motor 40 in gear and at idle speed. In some aspects, the dual-mode switch 250 (e.g., a click dial) can be used to adjust the throttle 20. As described herein, the outer ring 252 can be turned clockwise or counter-clockwise about the core portion 254 to increase or decrease the throttle position (also referred to herein as throttle-power setting), which can be displayed on the display screen 210 as a percentage of full throttle. In some aspects, pressing and releasing the core portion 254 can change the throttle-resolution resulting from the turning of the outer ring 252.

For example, in a coarse-adjustment mode of operation, advancing the outer ring 252 one click can change the throttle value by 1.0%, while in a fine-adjustment mode of operation the throttle value can change by 0.1%. As described herein, an indicator 230 can light when the dual-mode switch 250 is in the fine-adjustment mode. Adjustment of the throttle in the manual mode 500 can be performed through the remote 400 by pressing the Up remote button 420*c* or the Down remote button 420*d* to increase or decrease the throttle 20. In some arrangements, the remote 400 can be used to switch between coarse-adjustment and fine-adjustment modes of the dual-mode switch 250 by pressing the Res (i.e., resolution) remote button 420*e*.

In some aspects, the manual mode 500 can be configured so that the dual-mode switch 250 and the remote 400 are auto-ranging in that when the throttle is decreased below 1%, the resolution of the throttle adjustment automatically switches to the fine-adjustment mode (e.g., 0.1% incremental changes of the throttle position for each intermittent rotational click of the dual-mode switch 250). The same auto-ranging can be configured to occur if the throttle exceeds 99%. In some arrangements, the system 100 can be configured to switch from the fine-adjustment mode to the coarse-adjustment mode if the throttle adjustment is in fine-adjustment mode for an extended time (e.g., 20 seconds) without a change in the position of the outer ring 252 or input from the remote 400. This feature can promote safety in case a rapid throttle movement is required to avoid other boats or obstacles.

In some aspects, the manual mode 500 can be configured such that pressing the Idle/Run button 220*c* or the I-R remote button 420*a* causes the throttle to toggle between a trolling position and an idle position. In some arrangements, the manual mode 500 can be configured so that pressing and holding the Max button 220*d*, or the Max remote button 420*f*, gradually increases the throttle until the throttle reaches 100%. Release of the Max button 220*d*, or of the Max remote button 420*f*, can allow the throttle to return to the trolling speed. In some configurations, the manual mode 500 can be configured to show in the last idles function 720 on the display screen 210, when the Prog/Func button 220*g* is pressed, the last three throttle settings that were used when the Idle/Run button 220*c* was pressed. The last used throttle settings can be useful information if those throttle settings were productive fishing speeds.

Control System Operational Functions

As shown in FIG. 3, the system 100 can be configured to allow the user to execute precise throttle-control functions 700 in each of the manual mode 500 of operation and the hunt mode 600 of operation. As described herein, the throttle-control functions 700 can comprise, in some arrangements, ordered sets of a throttle-power setting paired with a power-duration setting. The conditions of a member of the ordered set are fulfilled by setting the throttle to the throttle-power setting and maintaining the throttle at the throttle-power setting for a duration of time equal to the power-duration setting. Upon the conclusion of the power-duration setting time span, the throttle-control function 700 moves the throttle to the throttle-power setting indicated by the next pairing of a throttle-power setting and power-duration setting in the ordered set of the throttle-control function 700. The control unit 200 can include the display 210, a keypad 222 with input buttons 220, and the dual-mode switch 250 through which a user can program, customize, and operate the throttle-control functions 700 that control the throttle 20 through the servo motor 300 (or digital controller).

In some arrangements, the control unit 200 can include circuitry necessary to obtain and process the speed signal of the fishing vessel from a GPS satellite network or a NMEA network in a boat. The system 100 can be configured to allow the user to input (e.g. via the dual-mode switch 250 or a wireless device) to the system 100 a desired GPS speed and the system 100 can self-adjust the throttle of the fishing vessel to achieve the desired GPS speed. In some aspects, software of the system 100 used to process the GPS-derived speed information can include logic to provide operational modes such as: an adjustable sampling rate of the speed signal to tailor the throttle adjustments from the system 100 to a level where the fishing vessel is stable so that the occupants do not lose their balance; an adjustable ramp rate of throttle application to tailor throttle response to the weight and size of the fishing vessel and weather conditions; a safety threshold that can determine when conditions are too variable for GPS speed tracking; an adjustable throttle ramp rate for the speed transitions in a hunt mode, for example for safety reasons.

Figure 4A:
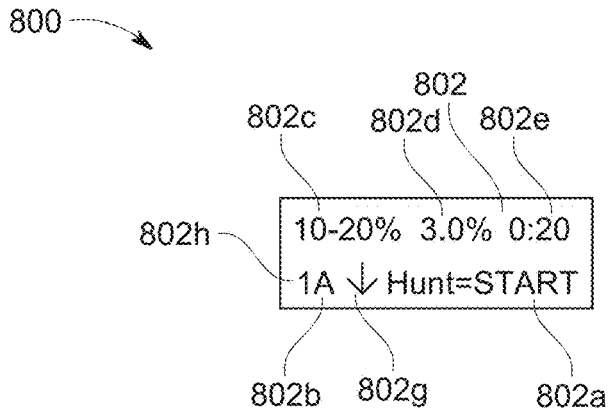
FIG. 4A depicts an illustrative, non-limiting example of a Hunt Start display of a robotic-throttle-control system, according to some aspects of the present disclosure.

FIG. 4A depicts an illustrative non-limiting graphical display 800, the Hunt Start display 802, which can be shown on the display screen 210 of the control unit 200 upon the system 100 entering the hunt mode 600. In some arrangements, the hunt mode 600 can be accessed by pressing twice the Hunt button 220*b*, or by pressing once the Hunt remote button 420*b*. As described herein, the graphical display 800 can be designed to efficiently communicate information to the user, which is of utmost importance for safety reasons and less important reasons as well. The Hunt Start display 802 can include a Start indicator 802*a*, such as, for example, the word "START" displayed prominently in the lower right corner of the Hunt Start display 802 to quickly alert the user that the Hunt Start screen 802 is being displayed and that the system 100 is awaiting the user to select a program of throttle positions to perform in hunt mode 600.

In some aspects, the system 100 can include ten hunt programs in the memory of the processor unit 205. In some aspects, the system 100 can include more than ten hunt programs, or less than ten hunt programs in the memory. In some arrangements, the system 100 can have pre-programmed in the system memory ten functions 700, such as, for example, four Stepping functions 708, two cut functions 710, two bump functions 712, and two six-shooter functions 714. A user can select a hunt program by using the outer ring 252 to scroll through a menu of programs labeled, for example, A through J. The Hunt display 802 can include a Program indicator 802*b*, such as, for example, a character "A" through "J" corresponding to the function 700 being offered for selection. The Hunt display 802 can be used to select and execute various programs of the hunt mode 600. Once a program is selected, the program can be executed from the Hunt Start display 802 by pressing the core portion 254 of the dual-mode switch 250, or by pressing the Hunt remote button 420*b*.

In some aspects, a top line of the Hunt Start display 802 can display information about the throttle positions for a selected program. For example, the Hunt Start display 802 shown in FIG. 4A has a Range indicator 802*c* that indicates the range the throttle (e.g., throttle-power setting) will span during the program, which in this case is between a minimum of 10% and a maximum of 20%. The Hunt Start display 802 can include a Step indicator 802*d* that indicates the size of the next throttle change, which in this case is 3.0%. The Hunt Start display 802 can include a Time-Step indicator 802*e* that can display the duration the next change in the throttle position will be held. The Hunt Start display can include a Step-Direction indicator 802*g* to indicate whether the next change in throttle position will increase (e.g., up arrow displayed) or decrease (e.g., down arrow displayed) the throttle value. The Step-Direction indicator 802*g* may not be shown when the hunt mode 600 is running certain functions 700 (e.g., a Stepping function 708). The Hunt Start display 802 can also include an Index indicator 802*h*, which indicates the motor number the system 100 is controlling. For example, the Index indicator 802*h* can display "1" if the system 100 is in a single-motor mode, or if the system 100 is controlling the first motor in a multiple motor set up of the system 100. The Hunt Start display 802 can be configured to help a user modify or customize a hunt program. In some arrangements, the Prog/Func button 220*g* is pressed twice to begin reprogramming screens, as described herein. In some aspects, the reprogramming mode can be exited by pressing the Back/Exit button 220*f* or the Res remote button 420*e*.

In some aspects, the Stepping function 708 can have low and high throttle settings and be configured to step up and down in the range between the low and high settings. The user can set a step size for the system to determine how many steps there are between the throttle settings. The stepping function 708 can excel in finding what speed and bait combination works best. For example, as shown in FIG. 4A, a user could set a program to vary the boat's throttle from 10% to 20% in 3% steps, with each step being held for 20 seconds. For this program, the throttle 20 will hit eight different speeds: 10%, 13%, 16%, 19%, 20%, 17%, 14%, 11%, 10%, and repeat. Searching programs can be a most efficient way to find what baits and speeds are the most productive to fish. For using the aforementioned eight-speed example of FIG. 4A with six different baits, would produce a combination of forty-eight bait-speed presentations (6 baits X 8 speeds=48 bait-speed presentations) being made to the fish every two minutes and 40 seconds.

Figure 4B:
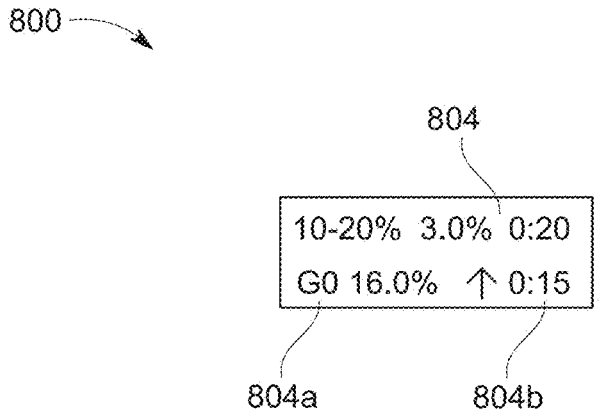
FIG. 4B depicts an illustrative, non-limiting example of a Hunt Timer display of a robotic-throttle-control system, according to some aspects of the present disclosure.

FIG. 4B depicts an illustrative non-limiting graphical display 800, the Hunt Timer display 804, which can be displayed on the display screen 210 of the control unit 200 upon the system 100 executing a function 700 in the hunt mode 600. In some aspects, the Hunt Timer display 804 can include in a Gain indicator 804*a* that displays the level of Hunt Gain being used, which in this case is "0". The Gain indicator 804*a* can be a combination of a numeric value of the gain (e.g., an integer between −7 and 7) preceded by the character "G" to indicate the gain is being displayed. The top line of the Hunt Timer display 804 can display information about the selected program, as previously described with regard to the Hunt Start display 802. In some aspects, the Hunt Timer display 804 can include a Timer indicator 804*b* that counts down to alert the user a hunt program is running and the time remaining before the throttle 20 is moved to the next throttle position indicated by the throttle-control function 700.

In some aspects, the Hunt Timer display 804 can be configured as an interface through which a user can modify the execution of a throttle-control function 700 that is running in the hunt mode 600. For example, the system 100 can be configured so that pressing the Hunt button 220*b* or the HNT remote button 420*b* can jump to the next throttle step in the throttle-control function 700 that is running in the hunt mode 600. The ability to change speeds on demand before the hunt mode timer would do so automatically is a powerful tool. If fish are shown on the user's graph, the user can estimate when the baits are right on top of the fish and the user can force the system 100 to change speed (e.g., go to the next step in the running function 700) by pressing the Hunt button 220*b*.

In some configurations, a Max throttle function 716 can be achieved by pressing and holding the Max button 220*d* or the Max remote button 420*f* can gradually increase the throttle until the throttle reaches 100%, while releasing the Max button 220*d* or the Max remote button 420*f* returns the throttle 20 to the trolling position. The SCS function 702 can be accessible in both the manual mode 500 and the hunt mode 600. The SCS function 702 can allow a user to set or maintain a higher throttle position setting than where the dual-mode switch 250 is set (e.g., in manual mode), or the throttle setting that a hunt mode is at, without requiring the user to touch the dual-mode switch 250. The SCS function 702 can allow the user to raise bait when crossing low spots or to use a higher throttle setting to get the fishing vessel back on course after, for example, after the vessel encounters wind gusts or wakes. Without the SCS function 702, the user would lose, or must reset, the troll speed because the dual-mode switch 250 movement would be required to increase the throttle 20. The SCS function 702 can be set by pressing and holding the Max button 220*d* or the I-R remote button 420*a* to advance the throttle 20, and then pressing the Idle/Run button 220*c* or the I-R remote button 420*a* to stop advancement of the throttle 20. The SCS function 702 can be configured to release the secondary cruising speed by pressing the Idle/Run button 220*c* or the I-R remote button 420*a*.

In some aspects, the system 100 can include a drag function 704 that is available in the manual mode 500 or the hunt mode 600. The drag function 704 can change the standard operation of the Idle/Run button 220*c* from a two-stage operation to a three-stage operation. For example, with drag mode on and the throttle in a position for trolling (e.g., 15%), pressing the Idle/Run button 220*c* (or the I-R remote button 420*a*) will cause the throttle position to drop to a drag speed position (e.g., 5%), and pressing the Idle/Run button 220*c* with the throttle in the drag speed position will drop the throttle to the idle position. Pressing the Idle/Run button 220*c* (or the I-R remote button 420*a*) with the throttle 20 in the idle position and the drag function 704 on, will cause the throttle 20 to be moved to the trolling position. With the drag function 704 off, pressing the Idle/Run button 220*c* (or the I-R remote button 420*a*) with the throttle 20 in a position for trolling, will drop the throttle 20 to the idle position, and pressing the Idle/Run button 220*c* (or the I-R remote button 420*a*) with the throttle 20 in the idle position will cause the throttle 20 to resume the throttle position for trolling. The dual-mode switch 250 (or the Up and Down remote buttons 420*c*, 420*d*) can be used to adjust the drag speed of the drag function 704. The drag speed can be a throttle setting that is lower than the trolling speed but higher than idle. The drag function 704 can allow a user to fight fish while using throttle to maintain the boat's heading or to raise bait to keep the bait from snagging bottom. In some configurations, the system 100 flashes the keypad 222 twice per second to indicate the drag function 704 is on. In some arrangements, the drag speed will be displayed when the system 100 is in the manual mode 500 and the Max button 220*d* is pressed. If the trolling speed is less than the drag speed stored in memory, the drag function 704 can be configured to not function when the Idle/Run button 220*c* is pressed because the system 100 will not accelerate the boat when the user expects the throttle to be reduced. To make the drag function 704 run again, the user can raise the troll speed higher than the drag speed.

In some arrangements, the Hunt Timer display 804 can assist reprogramming of the parameters of a hunt function (e.g., Stepping function 708). The reprogramming feature of the hunt mode 600 can be accessed by pressing the Prog/Func button 220*g* twice while either the Hunt Start display 802 or the Hunt Time display 804 is shown on the display screen 210. In some aspects, the system 100 can be configured so that pressing the Back/Exit button 220*f* or the RES remote button 420*e* while the Hunt Time display 804 is shown will cause the system 100 to stop the function 700 running in the hunt mode 600, position the throttle 20 to idle, and to display the Hunt Start display 802 on the display screen 210.

Figure 4C:
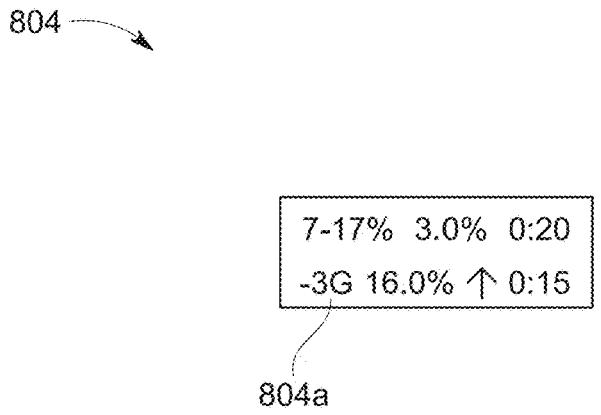
FIG. 4C depicts an illustrative, non-limiting example of a Hunt Timer display of a robotic-throttle-control system, according to some aspects of the present disclosure.
Figure 4D:
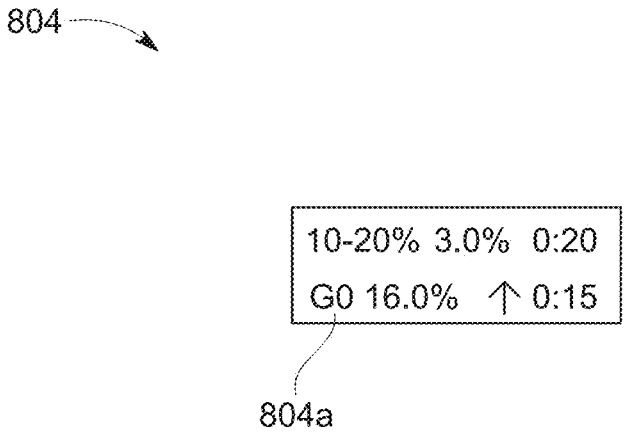
FIG. 4D depicts an illustrative, non-limiting example of a Hunt Timer display of a robotic-throttle-control system, according to some aspects of the present disclosure.
Figure 4E:
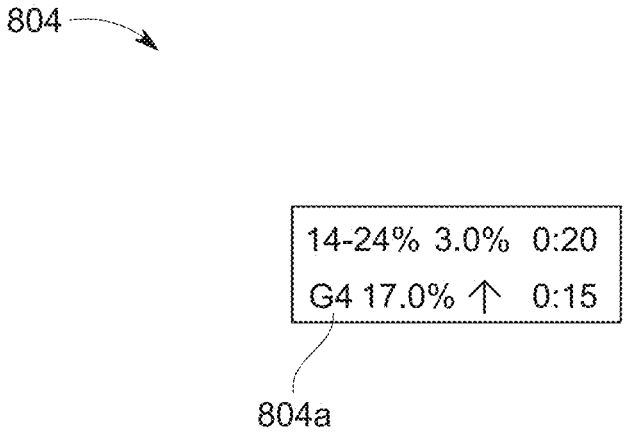
FIG. 4E depicts an illustrative, non-limiting example of a Hunt Timer display of a robotic-throttle-control system, according to some aspects of the present disclosure.

FIGS. 4C-4E depict exemplary Hunt Timer displays 804 that are helpful for explaining the gain function 706 of the hunt mode 600. The gain function 706 can allow a user to "slide" the throttle settings up or down while a function 700 is running in the hunt mode 600. The gain function 706 can be useful to account for changes in wind, swell, current, or other factors by up to 7% (up or down) in 1% increments. The gain function 706 can reduce the need for reprogramming a function 700 running in the hunt mode 600. In some configurations, the gain function 706 can allow the hunt gain of a function 700 running in the hunt mode 600 to be adjusted with the dual-mode switch 250 (or the Up and Down remote buttons 420*c*, 420*d*). The gain adjustment mode can be exited by pressing the core portion 254 or by doing nothing for a delay of twenty seconds. A twenty-second delay can be useful to allow the user time to assess the effect of the gain that was dialed in.

In some aspects, the gain function 706 does not permanently alter the base hunt parameters that are stored in the system 100 memory (e.g., processor unit 205). When a user increases or decreases the gain setting value, the system 100 adds or subtracts the value of the gain setting from the throttle-power settings of the base parameters, but the system 100 does not permanently alter these base parameters. In some aspects, the gain function 706 provides instant throttle feedback. For example, when gain is changed, the throttle will change on a one-to-one basis with the amount of gain. In other words, if the user increases gain by plus or minus two, the throttle will go up or down 2%. This allows the user to see, in real time, how the change affects boat control. In some configurations, gain can increase the base parameters in 1% increments to a maximum gain value of 7%. For example, a base throttle of 10-20% with 7% gain is 17-27%. In some aspects, if the minimum speed equals zero, the gain cannot be decreased further.

In some aspects, the amount of negative gain that is available to be applied to the parameters of the function 700 can depend upon the type of function 700 that is being run in the hunt mode 600. In some arrangements, the gain that is available may be limited if the lowest throttle setting of a hunt function 700 is 6% or less. For example, the system 100 can be configured so that when the system 100 is running a stepping function and the minimum speed equals zero, the gain cannot be decreased further. In some aspects, the cut function 710 and the bump function 712 can have only two throttle settings. If the lowest throttle setting value of the cut function 710 or the bump function 712 becomes zero, further reductions in gain will result in lowering only the upper throttle setting. The hunt function 700, in this case, is undergoing compression, which makes the gain even more powerful when the gain is increased. In some arrangements, gain decreases can stop if the upper throttle equals 1%. An example of cut compression with decreasing gain can be appreciated by considering a user operating the system 100 to provide a cut speed of 0%, and a troll speed of 8%. The user trolls at 8% and cuts to idle (0%) because it provides rapid boat slowing on the cut. These settings work well in calm conditions. If the wind now picks up and is at the user's back, the user can begin trolling too fast. Gain compression can be used to decrease trolling speed to maintain the targeted trolling speed while still cutting to idle. Should the wind shift to be in the user's face, the user can increase gain. If gain becomes positive, both the cut speed and the trolling speed are increased to add additional power to maintain direction control of the fishing vessel.

In some aspects, decreasing the gain can cause compression of a bump function 712. For example, if the trolling speed is 5% and the bump is to 12%, the settings may work well in calm water. Wind shifting to be at the user's back may make the trolling speed too fast. Gain compression can allow the user to decrease the trolling speed to maintain a target trolling speed. If a gain of negative 6 or 7 is selected, the trolling speed will be 0% and the bump speed will be either 5% or 6%. If the wind shifts to be in the user's face, the user can increase the gain. If gain becomes positive, both the trolling speed and the bump speed are increased to add additional power to help maintain boat control. In some aspects, the system 100 can be configured so that no limit is placed on the gain when a six-shooter function 714 is being run, allowing the gain to be set as low as negative 7%. In some cases, excessive negative gain can make the six-shooter function 714 appear to do nothing if the selected gain reduces all throttle settings to 0%

FIG. 4C depicts the gain operation for a Hunt Timer display 804 of a Stepping function 708 running in the hunt mode 600. In the illustrated arrangement, the Gain indicator 804*a* indicates that the value of the gain setting is −3, and the Stepping function 708 will start at a throttle-power setting of 7% and step up to 17% in 3% step intervals. FIG. 4D depicts a Stepping function 708 running in the hunt mode 600 in which the gain is 0, the Stepping function 708 starts at 10% and steps up to 20% in 3% step intervals. FIG. 4E depicts a Stepping function 708 running in the hunt mode 600 in which the gain is +4, the Stepping function 708 starts at 14% and steps up to 24% in 3% step intervals.

Figure 4F:
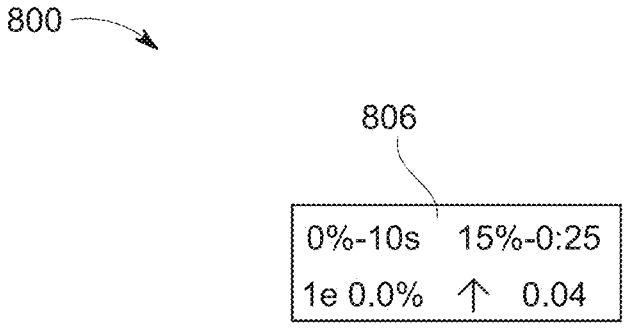
FIG. 4F depicts an illustrative, non-limiting example of a Hunt Timer display of a robotic-throttle-control system, according to some aspects of the present disclosure.

FIG. 4F depicts a cut display 806 that can be displayed to indicate to the user that the system 100 is in the hunt mode 600 and running a cut function 710. The cut function 710 can simulate a wounded bait. The cut function 710 can be a two-speed program where the trolling speed is cut to a slower speed. In some aspects, the user can the time parameters regarding when the throttle 20 is cut and how long the cut lasts. The time at troll can be programmable from a short duration (e.g., 5 seconds) to a long duration (e.g., 4 minutes), and the cut time can be set in seconds. For example, FIG. 4F illustrates a cut display 806 where the user has set a program to troll at 15% throttle for twenty-five seconds, then cut the throttle to idle (0%) for ten seconds before returning to 15% and repeating the pattern. In some aspects, bait behavior in the cut function 710 can be customized by how large or small the cut is and how long the throttle stays cut.

Figure 4G:
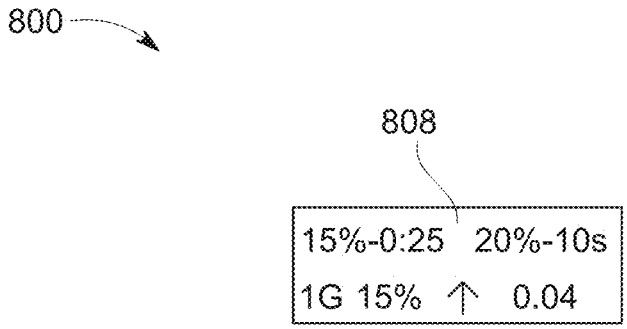
FIG. 4G depicts an illustrative, non-limiting example of a Hunt Timer display of a robotic-throttle-control system, according to some aspects of the present disclosure.

FIG. 4G depicts a bump display 808 that can be displayed to indicate to the user that the system 100 is in the hunt mode 600 and running a bump function 712. The bump function 712 can be a two-speed program where the trolling speed is bumped to a higher speed. The bump function 712 can simulate a fleeing bait. The user can set the time parameters as to when the throttle 20 is bumped and how long the bump lasts. The time at troll can be for a short duration (e.g., five seconds) to a long duration (e.g., four minutes). For example, FIG. 4G illustrates a bump display 808 where the user has set a program to troll at 15% throttle for 25 seconds, then bump the throttle to 20% for 10 seconds before returning to 15% and repeating the pattern. Bait behavior in the bump function 712 can be customized by how large or small the bump is and how long the throttle stays bumped.

Figure 4H:
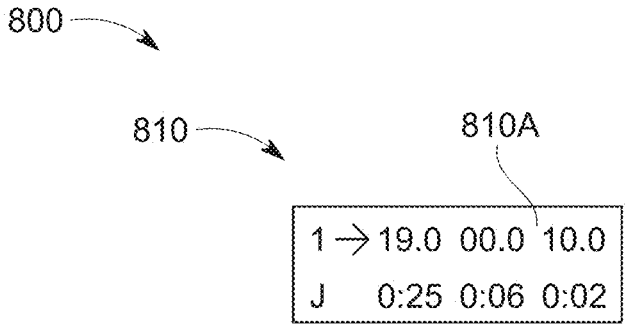
FIG. 4H depicts an illustrative, non-limiting example of a Six-shooter Start display of a robotic-throttle-control system, according to some aspects of the present disclosure.
Figure 4I:
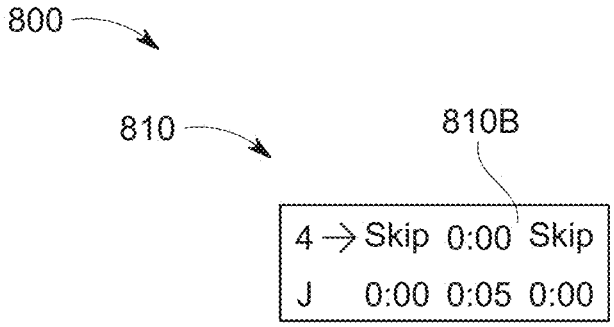
FIG. 4I depicts an illustrative, non-limiting example of a Six-shooter Start display of a robotic-throttle-control system, according to some aspects of the present disclosure.

FIGS. 4H and 4I each depict a portion of a Six-shooter Start display 810. As described herein, the Six-shooter Start display 810 can include a first-half display 810A and a second-half display 810B. The system 100 can be configured to toggle between the first-half display 810A and the second-half display 810B, displaying each for a toggle-delay time (e.g., ten seconds). In some arrangements, a user can override the toggle-delay time by pressing an input button 220 (e.g., the Max button 220). The six-shooter function 714 can allow a user to set between two and six throttle steps with independent time settings. The six-shooter function 714 can allow the user to choose how many throttle setting are to be run by determining if a throttle is valid (will be run) or invalid (will be skipped). The time setting of a throttle-time pairing determines if a throttle is valid or invalid. Valid throttle settings have time values above zero seconds, where those with a time value of zero are skipped. When a throttle value is skipped, the Six Shooter Start display 810 can show the word "skip" instead of the numerical throttle setting. This allows the user unprecedented freedom to make double cut or bump programs, a cut with a twitch, or anything the user can think of. The Six-shooter Start displays 810A, 810B can have the throttle and time pairings vertically stacked with one another, as shown in FIGS. 4H and 4I, which illustrate the throttle and time pairings of a cut function 710 with a throttle twitch in the cut. Specifically, in the illustrated arrangement the six-shooter function 714 will troll at 19.0% for 25 seconds, cut to idle (0.0%) for 6 seconds, throttle at 10% for a twitch of two seconds, cut to idle for 5 seconds, and then return to the first time-throttle pairing (19.0%, 25 seconds); the fourth and sixth pairs of this example have a zero time parameter and therefore the throttle speeds in those pairs are shown as to be skipped on the display.

Figure 4J:
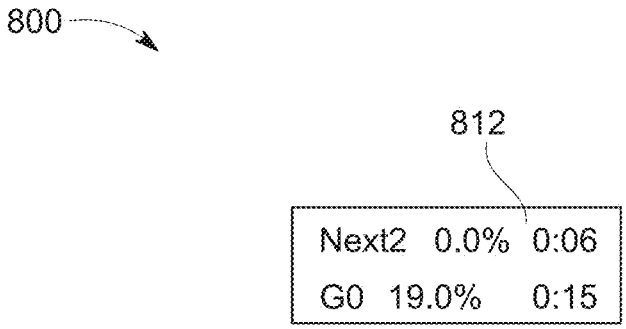
FIG. 4J depicts an illustrative, non-limiting example of a Six-shooter Timer display of a robotic-throttle-control system, according to some aspects of the present disclosure.

FIG. 4J depicts a Six-shooter Timer display 812 that can be displayed to indicate to the user that the system 100 is in the hunt mode 600 and running a six-shooter function 714. The top line of the Six-shooter Timer display 812 can show which throttle and time pair is next (in this case—Pair 2) and the throttle and time settings of that pair. The bottom line of the Six-shooter Timer display 812 can show the hunt gain (in this case zero), the current throttle setting, and how much time until a throttle change.

In some aspects, the Stepping function 708 can be effective when set to make the hunt functions 700 stop at different speeds on the way up than on the way down for maximum speed variety. In some aspects, a user can select step number by subtracting the minimum speed from the maximum speed and if the difference is an even number, use an odd number of steps and vice versa. In some aspects, when a hunt function 700 finds a speed that the fish prefer (e.g., 18%), it may be advisable for the user to not go to manual throttle and static troll at 18%. Rather the user can bracket 18% so when the fish's speed preference changes, as it often will, the user will notice the pattern where fish strikes occur. A sample program that brackets 18 could be (15-21%, 3%, 20 seconds). This hunt function 700 will cover these speeds: 15%, 18%, and 21%. In some aspects, the cut function 710 and the bump function 712 allow the user to vary presentation by varying the degree and duration of the cut or bump speed. The user can put a bait in the water and try a moderate cut or bump (e.g., 5%) for 10-15 seconds versus a larger cut or bump (e.g., 10-15%) for 1-4 seconds.

Figure 4K:
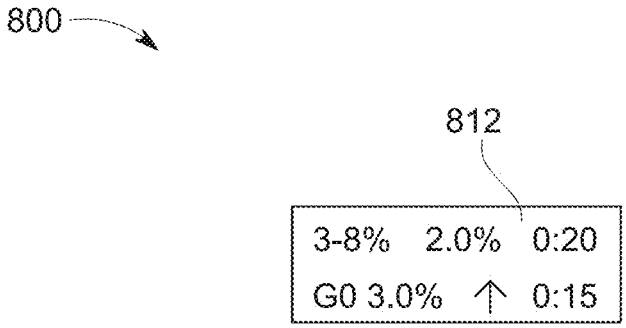
FIG. 4K depicts an illustrative, non-limiting example of a display of a robotic-throttle-control system, according to some aspects of the present disclosure.
Figure 4L:
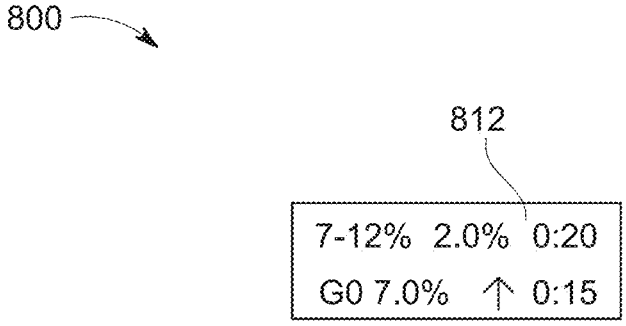
FIG. 4L depicts an illustrative, non-limiting example of a display of a robotic-throttle-control system, according to some aspects of the present disclosure.

In some aspects, the system 100 can include a hunt gain offset to enhance slow trolling programs. If a user is employing slow-trolling techniques, the user may benefit from offsetting the hunt function 700 for more versatility. For example, FIG. 4K illustrates the programmed throttle values for a stepping function 708 that cannot exploit the full spectrum of the gain because the gain cannot be decreased below negative three (−3) given that such a decrease will bring the minimum speed to zero. Thus, the throttle positions of FIG. 4K leave four gain points unused. To reclaim the four leftover gain points not being utilized in FIG. 4K, the user can offset the programmed values, as shown in FIG. 4L. In FIG. 4L, the throttle values of the stepping function 708 of FIG. 4K have been increased by 4%. Now the minimum speed is 7%, allowing the gain to be decreased to its fullest extent of negative seven (−7) before bringing the minimum speed to 0%. The same offset procedure can be created with more power at the top end of the program to troll in wind or swell.

In some aspects, the system 100 can be configured to allow an idle point adjustment procedure to be performed. In some aspects, the idle point adjustment procedure may be a one-time adjustment that is initially performed with the system 100 is installed. The system 100 can be configured to adjust the idle position of the servo motor 300 (or digital controller). The idle point adjustment can allow a user to take up the slack in the cable or rod that pulls on the throttle 20 of the motor 40. Excessive slack can create a dead spot at idle until the servo motor 300 moves enough to remove the slack. When properly adjusted, at idle the throttle 20 should be fully closed and have started to open between 1% and 1.5% throttle as indicated on the display screen 210. In some aspects, the user must not set the idle point adjustment too low. For example, if the throttle 20 is opening at 0.5% throttle position, there is a chance that when the motor 40 is hot, parts in the motor 40 can expand and the throttle 20 will not be fully closed at 0% throttle. In some configurations, the idle point can be changed by turning on the system 100, putting the system 100 into idle mode (e.g., by pressing the Idle/Run button 220*c*), and then, when the system 200 is at idle, pressing and holding the core portion 254 for ten seconds until an idle point adjustment display is shown on the display screen 210. The outer ring 252 of the click dial 250 can be used to change the idle point adjustment value from a range between 0% to 10% (in 0.5% increments). The core portion 254 can be pressed to set the new idle point at the selected value. This selected value is the new servo arm position at 0% throttle. In some arrangements, the system 100 can include independent idle point adjustment values for each motor when the system 100 is configured as a multi-motor system 100.

FIG. 5 presents a non-limiting, illustrative example of a hunt gain compression 900 for a two-speed hunt function 700. As described herein, gain compression is an aspect of the system 100 wherein when the gain is decreased and any throttle settings have been reduced to zero, further decreases in gain will result in decreasing further only those throttle settings that are above zero. This prevents negative value throttle settings and makes the hunt mode 600 operations of the system 100 more versatile. As can be appreciated from FIG. 5, if the program has undergone compression and the gain value is being increased, the compression will unwind in the same manner as the compression occurred. Similarly, as can be appreciated also from FIG. 5, if compression occurred, the compression reversed becomes a gain expansion. Suppose a user is operating a cut function and encounters a headwind. If gain becomes positive, both the cut speed and the troll speed can be increased to add additional power to maintain directional control of the boat. Similarly, suppose a user is using a bump function and encounters a headwind. The user can increase gain, and if gain becomes positive, both the troll speed and the bump speed can be increased to add additional power to help the user maintain directional control of the boat.

Other Variations and Terminology

While certain embodiments have been described, these embodiments have been presented by way of example only and are not intended to limit the scope of protection. Indeed, the novel methods and systems described herein may be embodied in a variety of other forms. It will be further understood by those skilled in the art that the present disclosure extends beyond the specifically disclosed embodiments to other alternative embodiments or uses and obvious modifications and equivalents thereof, including embodiments which do not provide all of the features and advantages set forth herein. Furthermore, various omissions, substitutions, and changes in the form of the methods and systems described herein may be made. Those skilled in the art will appreciate that in some embodiments, the actual steps taken in the processes illustrated or disclosed may differ from those shown in the figures. Depending on the embodiment, certain of the steps described above may be removed; others may be added. Accordingly, the scope of the present disclosure is not intended to be limited by the specific disclosures of preferred embodiments herein and may be defined by claims as presented herein or as presented in the future. The language of the claims is to be interpreted broadly based on the language employed in the claims and not limited to the examples described in the patent specification of during prosecution of the application, which examples are to be construed as non-exclusive.

Features, materials, characteristics, or groups described in conjunction with a particular aspect, embodiment, or example are to be understood to be applicable to any other aspect, embodiment, or example described herein unless incompatible therewith. All of the features disclosed in this specification (including any accompanying claims, abstract, and drawings), or all of the steps of any method or process so disclosed, may be combined in any combination, except combinations where at least some of such features or steps are mutually exclusive. The protection extends to any novel one, or any novel combination, of the features disclosed in this specification (including any accompanying claims, abstract, and drawings), or to any novel one, or any novel combination, of the steps of any method or process so disclosed.

Conditional language, such as "can," "could," "might," or "may," unless specifically stated otherwise, or otherwise understood within the context as used, is generally intended to convey that certain embodiments include, while other embodiments do not include, certain features, elements, or steps. Thus, such conditional language is not generally intended to imply that features, elements, or steps are in any way required for one or more embodiments. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

What is claimed is:

1. A robotic throttle-control system for controlling a throttle of a fishing vessel, the system comprising:

a control unit configured to control a throttle-power setting of the throttle;

a processor unit within the control unit and configured to instruct the control unit of the throttle-power setting, the processor unit further configured to instruct the control unit of a power-duration setting corresponding to a time span for maintaining the throttle at the throttle-power setting; and wherein a user interface of the control unit comprises a dual-mode switch configured to communicate to the processor unit through each a rotational position of the dual-mode switch and an axial position of the dual-mode switch.

2. The system of claim 1, wherein the dual-mode switch comprises a dial circumferentially surrounding a core, the core configured as a press button.

3. The system of claim 2, wherein the core is movable axially relative to the dial.

4. The system of claim 1, wherein the processor unit is further configured to adjust the throttle-power setting by a gain value selected through the dual-mode switch.

5. The system of claim 4, wherein the processor unit is configured to adjust in real time the throttle-power setting for a hunt mode being run by the processor unit.

6. The system of claim 1, wherein the processor unit is configured to sense whether a rotational speed of the dual-mode switch exceeds a safety-threshold value and further configured upon detecting the dual-mode switch is rotating faster than the safety-threshold value to disregard a rotation-based input from the dual-mode switch.

7. The system of claim 1, wherein the control unit further comprises an auto-ranging feature configured to adjust the throttle in a fine-adjustment mode for a throttle-power setting decreased below 1% or increased above 99%.

8. A method of controlling a throttle of a fishing vessel, the method comprising:

instructing a processor of a throttle-control unit a sequence of throttle settings to use in a hunt mode;

informing the processor of a value of a gain setting; and setting, with the throttle-control unit, a power-setting of the throttle according to the hunt mode and the gain setting.

9. The method of claim 8, wherein informing the processor of the value of the gain setting comprises rotating a dual-mode switch of a user interface of the throttle-control unit.

10. The method of claim 8, wherein the hunt mode comprises a range of throttle-power values and a step-size value, and wherein setting comprises moving the throttle-power setting through the range by increasing iteratively the throttle-power setting by the step-size value.

11. The method of claim 10, wherein setting further comprises moving the throttle-power setting through the range by decreasing iteratively the throttle-power setting by the step-size value.

12. The method of claim 8, wherein the hunt mode comprises a first throttle-power value, a first power-duration value, a second throttle-power value, and a second power-duration value, and wherein setting comprises setting the throttle at the first throttle-power value and maintaining the throttle at the first throttle-power value for a time span equal to the first power-duration value, and then setting the throttle to the second throttle-power value.

13. The method of claim 12, wherein setting further comprises maintaining the throttle at the second throttle-power value for a time span equal to the second power-duration value, and then setting the throttle to the first throttle-power value.

14. The method of claim 13, wherein the first throttle-power value is greater than the second throttle-power value.

15. A processor unit of a robotic-throttle control system, the processor unit configured to execute a method comprising:

accessing a memory storage of the robotic-throttle control system to find a hunt mode of operating a throttle of a fishing vessel, the hunt mode comprising an ordered list of a throttle-power setting paired with a throttle-duration setting;

displaying at least a portion of the ordered list on a display unit of the robotic-throttle control system; and adjusting a value of at least one of the throttle-power setting or the throttle-duration setting according to an input received from a user interface module of the robotic-throttle control system, wherein the user interface module comprises a dual-mode switch and adjusting comprises rotating the dual-mode switch about an axis of the dual-mode switch.

16. The processor unit of claim 15, wherein adjusting comprises moving the dual-mode switch along the axis.

17. The processor unit of claim 15, wherein the dual-mode switch comprises a dial concentric with and radially outward from a core.

18. The processor unit of claim 15, wherein adjusting comprises adding a gain value to at least one of the throttle-power settings.

19. The processor unit of claim 18, wherein the gain value can be adjusted with the dual-mode switch.

20. The processor unit of claim 18, wherein the gain value is within a range of −7 to 7.

* * * * *